US008339117B2

(12) United States Patent
Sicard

(10) Patent No.: US 8,339,117 B2
(45) Date of Patent: Dec. 25, 2012

(54) START-UP CIRCUIT ELEMENT FOR A CONTROLLED ELECTRICAL SUPPLY

(75) Inventor: Thierry Sicard, Tournefeuille (FR)

(73) Assignee: Freescale Semiconductor, Inc., Austin, TX (US)

( * ) Notice: Subject to any disclaimer, the term of this patent is extended or adjusted under 35 U.S.C. 154(b) by 190 days.

(21) Appl. No.: 12/669,520

(22) PCT Filed: Jul. 24, 2007

(86) PCT No.: PCT/IB2007/055361

§ 371 (c)(1),
(2), (4) Date: Jan. 18, 2010

(87) PCT Pub. No.: WO2009/013572

PCT Pub. Date: Jan. 29, 2009

(65) Prior Publication Data

US 2010/0181987 A1 Jul. 22, 2010

(51) Int. Cl.
*G05F 3/16* (2006.01)

(52) U.S. Cl. ..... 323/315; 323/901

(58) Field of Classification Search ..... 323/313–315, 323/901; 363/49; 327/143, 198, 538, 546
See application file for complete search history.

(56) References Cited

U.S. PATENT DOCUMENTS

| | | | | |
|---|---|---|---|---|
| 5,742,155 | A | 4/1998 | Susak et al. | |
| 5,867,013 | A | 2/1999 | Yu | |
| 6,016,050 | A | 1/2000 | Brokaw | |
| 6,084,388 | A * | 7/2000 | Toosky | 323/313 |
| 6,509,784 | B2 * | 1/2003 | Seinen et al. | 327/530 |
| 7,312,601 | B2 * | 12/2007 | Mihara | 323/312 |
| 7,728,574 | B2 * | 6/2010 | Kalyanaraman | 323/313 |
| 7,915,882 | B2 * | 3/2011 | Hellums | 323/312 |
| 7,944,195 | B2 * | 5/2011 | Jang | 323/314 |
| 2004/0124823 | A1 | 7/2004 | Fulton et al. | |

FOREIGN PATENT DOCUMENTS

EP 1102400 A 5/2001

OTHER PUBLICATIONS

Brokaw A. Paul: "A Simple Three-Terminal IC Bandgap Reference" IEEE Journal of Solid-State Circuits, vol. SC-9, No. 6, Dec. 1974.
International Search Report and Written Opinion correlating to PCT/IB2007/055361 dated May 8, 2008.

* cited by examiner

*Primary Examiner* — Adolf Berhane

(57) ABSTRACT

Electrical supply apparatus comprising a start-up circuit element coupled to an output element for ensuring reliable start-up when first connected to a source of power. The start-up circuit element comprises first and second branches with current mirror coupling therebetween. The first branch comprises first and second transistors of opposite polarities for connection in series between the source of power and ground and a leakage path to ground in parallel with the second transistor for start-up current for the first transistor of the first branch in response to application of voltage from the source of power. The current mirror coupling between the first and second branches responds to start-up of the first transistor of the first branch to start up a first transistor of the second branch and provide start-up current to the output element. The second branch may comprise a control element connected to turn off the second transistor of the first branch on start up of the output element and turn off the first transistors. Alternatively, the start-up circuit may have elements common with the output circuit and remain conductive after the output circuit starts.

17 Claims, 4 Drawing Sheets

START-UP CIRCUIT ELEMENT FOR A CONTROLLED ELECTRICAL SUPPLY

FIELD OF THE INVENTION

This invention relates to a start-up circuit element for a controlled electrical supply and a controlled electrical supply including such a start-up circuit element.

BACKGROUND OF THE INVENTION

Electrical supplies are used in a wide variety of applications to supply a controlled reference voltage or current. One kind of widely used voltage reference supply is a band-gap circuit, which has typically been used to provide a low reference voltage with stability in the presence of temperature variations and noise or transients. In one form of band-gap circuit, described in the article "A simple Three-Terminal IC Bandgap Reference" in IEEE Journal of Solid-State Circuits, vol. SC9, n° 6, December 1974, two groups of junction-isolated bipolar transistors run at different emitter current densities. The difference in emitter current densities produces a related difference between the base-emitter voltages of the two groups. This voltage difference is added to the base-emitter voltage of the transistor with higher emitter current density with a suitable ratio defined by a voltage divider. The temperature coefficient of the base-emitter voltage is negative and tends to compensate the positive temperature coefficient of the voltage difference.

Other examples of electrical supplies include current mirror circuits, in which two groups of transistors, such as Field-Effect Transistors (FET's), are cross-coupled, so that an output branch reproduces a desired current in a reference branch, whatever the output load it supplies. By using FETs of a current conducting area several times bigger than in the reference branch, for example an array of transistors in the output branch, the reference current can be multiplied by a similar factor. Current mirror circuits are used in a wide variety of applications, such as current sources or a voltage regulators.

Such electrical supplies are themselves supplied with power. It is important to ensure that the electrical supply starts operation reliably when the source of power is first connected or switched on. Differences of component characteristics due to manufacturing tolerances may mean that, even in a design whose ideal characteristics are expected to ensure reliable start-up, a proportion of the actual production fails to start, either at all, or at least within an acceptable time.

It is known to provide start-up circuit elements that themselves start reliably and provide a start signal, triggering start-up of the electrical supply. However it is important to minimise the additional components used in the start-up circuit elements. Also some start-up circuit elements start reliably only if the build-up of voltage from the source of power is sufficiently rapid. Moreover, in certain applications it is also necessary to avoid the start-up circuit elements introducing additional current consumption, at least after the start-up phase is completed, if their utility occurs only when power is first applied and additional power consumption in the start-up circuit would be wasteful during normal operation of the electrical supply, especially in the quiescent state of the electrical supply.

U.S. Pat. No. 5,867,013 describes a start-up circuit but needs an additional low voltage source to supply the start-up circuit. European patent specification 1 102 400 describes a start-up circuit for a band-gap circuit but has a residual static current when the output band-gap circuit has started. U.S. Pat. No. 2004/0 124 823 describes a start-up circuit but needs a regulated low voltage power supply for the start-up circuit. U.S. Pat. No. 5,742,155 describes a start-up circuit but needs an additional logic signal to command the start-up circuit.

The present invention addresses some or all of these issues.

SUMMARY OF THE INVENTION

The present invention provides electrical supply apparatus as described in the accompanying claims.

DETAILED DESCRIPTION OF THE PREFERRED EMBODIMENTS

Figure 1:
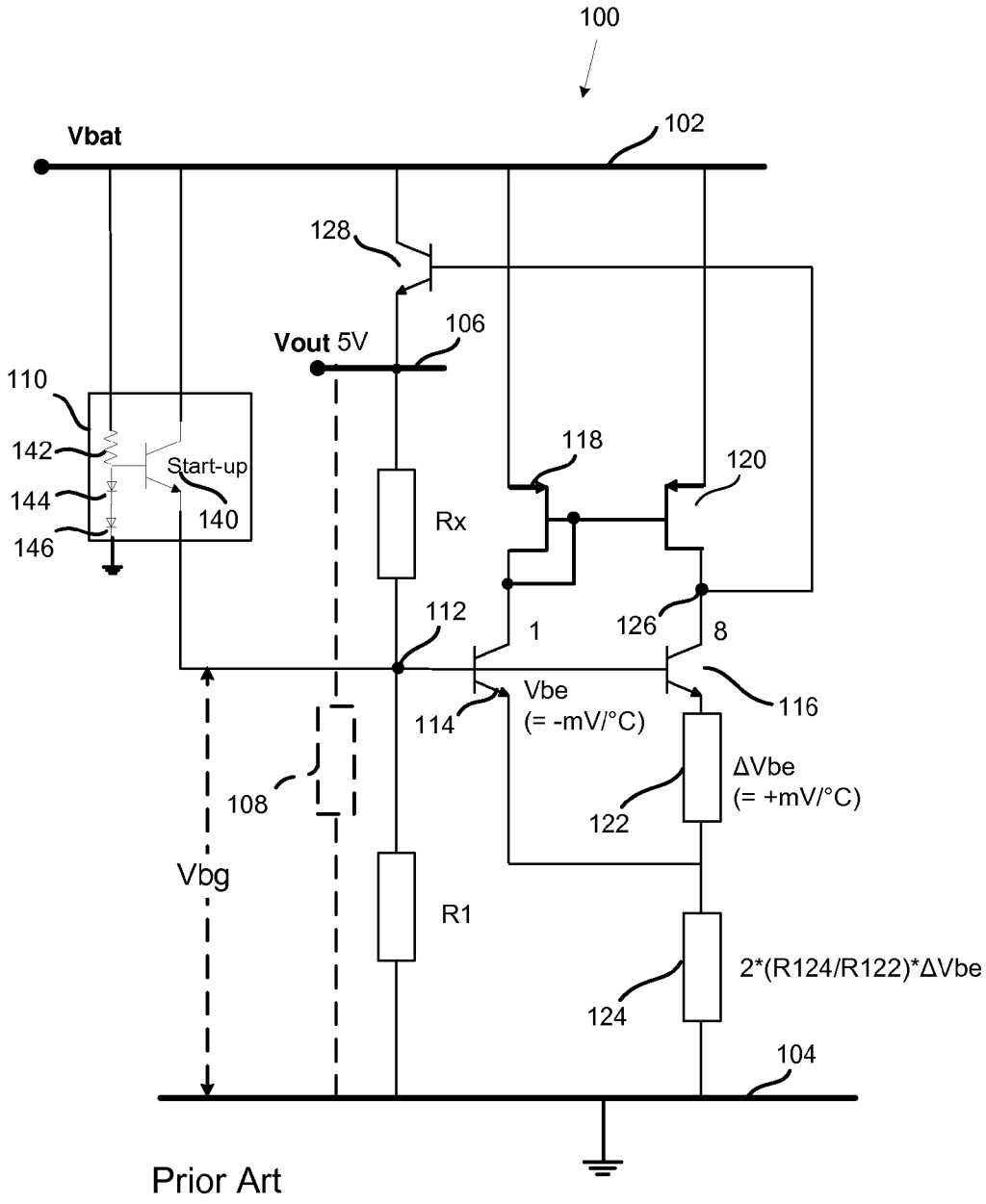
FIG. 1 is a schematic diagram of a voltage regulator in electrical supply apparatus, given by way of example.

FIG. 1 shows an example of an output circuit 100 in an electrical supply apparatus. The output circuit shown in FIG. 1 comprises a voltage regulator, which comprises a rail 102 supplied from a source of power, in this case a battery, not shown, with a voltage Vbat relative to a ground rail 104. The voltage Vbat will typically be 12 volts but may be up to 40 volts in some automotive applications, for example. The voltage regulator output circuit 100 supplies an output voltage Vbg, which is 5 volts in this example, on an output rail 106 to a load 108.

Voltage from the battery rail 102 is supplied through a start-up circuit 110 to a node 112 between two resistors Rx and R1, which are connected in series with the resistor Rx connected to the output rail 106 and the resistor R1 connected to ground 104. The node 112 is connected to common bases of a pair of npn transistors 114 and 116, whose collectors are connected through P-type metal-oxide-Silicon ('Pmos') FETs 118 and 120 respectively to the output rail 106. The emitter area of the transistor 116 is substantially larger than that of the transistor 114, in this case a factor of 8 times. The FETs 118 and 120 are coupled in a current mirror configuration, with their gates connected together and to the drain of FET 118 and their sources connected to the power supply rail 102. The emitter of transistor 116 is connected through a resistor 122 and then a resistor 124 in series to ground 104 and the emitter of transistor 114 is connected to the common point between resistors 122 and 124 and therefore through the resistor 124 to ground. The connection 126 between the collector of transistor 116 and FET 120 is connected to the base of a transistor 128, whose collector is connected to the battery rail 102 and whose emitter is connected to the output rail 106.

In the electrical supply apparatus shown in FIG. 1, the start-up circuit 110 is a known type of circuit, comprising an npn transistor 140 whose collector is connected to the battery supply line 102, whose emitter is connected to the node 112 and whose base is connected through a resistor 142 to the battery supply line 102and through two forward biased diodes 144 and 146 in series to ground.

In normal operation, the transistor 128 provides current to the bases of transistors 114 and 116, whose common base voltage rises, and the current in the transistor 114 increases until its emitter voltage has risen sufficiently for its base-emitter voltage Vbe to exceed its threshold voltage. The current mirror formed by FETs 118 and 120 drives the transistor 128 to stabilise the common base voltage of the transistors 114 and 116 to a value such that the currents are equal in transistors 114 and 116. The voltage divider formed by resistors Rx and R1 ensures that the voltage Vbe appearing across the base-emitter of the transistor 114 is multiplied by a chosen factor K to produce Vout=Vbg*(Rx+R1)/R1, where Vbg is the voltage between the node 112 and ground. In the example shown, the factor K is chosen to be 4.17, multiplying the voltage Vbg for Silicon transistors of 1.2 volts so that Vout equals 5.0 volts. The resistors R1, Rx, 122 and 124 present resistances that vary similarly with temperature, so that their ratio remains constant independently of temperature.

In more detail, the difference in current densities in the base-emitter junctions of the transistors 114 and 116 produces different base-emitter voltages in the transistors 114 and 116, so that the difference, ΔVbe, appearing across the resistor 122 is given by:

$$\Delta Vbe = \frac{kT}{q}\log n\frac{J114}{J116},$$

where k is the Boltzmann constant, T is the absolute temperature, q is the fundamental electron charge and J114 and J116 are the respective base-emitter junction areas of the transistors 114 and 116, the area J116 being chosen to be 8 times that of J114 in the example shown. Since the currents in transistors 114 and 116 are equal, the current in resistor 124 is twice that in resistor 122, so that the voltage across the resistor 124 is:

$$2\frac{R124}{R122}\frac{kT}{q}\log n\frac{J114}{J116}.$$

The voltage Vbg is the sum of this voltage, approximately 0.6 volts at room temperature and which varies positively with temperature and the base-emitter voltage Vbe of the transistor 116, also approximately 0.6 volts at room temperature and which varies negatively with temperature, so that $$Vbg = Vbe + 2\frac{R124}{R122}\frac{kT}{q}\log n\frac{J114}{J116}.$$

The resistances of 122 and 124 and the junction areas J114 and J116 are chosen so that the negative coefficient of temperature variation of the voltage Vbe (in this example approximately −2 mV/° K.) cancels the positive coefficient of temperature variation of the voltage difference ΔVbe (in this example approximately +2 mV/° K.) to a first order of approximation. The voltage Vbg, and hence the voltage Vout is substantially independent of variations in power supply voltage Vbat.

The parameters of the voltage regulator output circuit 100 of FIG. 1 are chosen so that it ought to be self-starting. However, there remains a risk that the circuit will not start by itself, due to various circumstances including unfavourable manufacturing variances and/or slow build up of the power voltage, for example. In particular, it is sufficient for one of the transistors 114 or 116 or the FETs 118 or 120 of the current mirror to fail to conduct for the non-conducting element to block the others and to prevent the voltage Vout from being established. Even if the situation allows leakage currents to start the regulator ultimately, the leakage currents may be too small relative to the parasitic capacitances of the circuit elements for the regulator to self-start without unacceptable delay. For example, the parameters of the circuit 100 are chosen (if possible) so that the leakage currents through FETs 118 and 120 when power is first applied are greater than those in the transistors 114 and 116, aided by parasitic currents flowing in the respective junction capacitances if the voltage Vbat is applied rapidly, so that the currents in the FETs 118 and 120 tend to pull up the voltages at the collectors of the transistors 114 and 116, turning them on once the threshold voltages of the transistors is reached. However, even in this case, there remain a statistical risk of unfavourable combinations of component values due to manufacturing tolerances making the leakage currents through one or both of the transistors 114 and 116 greater than those in the FETs 118 and 120, pulling the collectors of the transistors 114 and 116 down towards ground below the voltage of node 112, keeping the transistors 114 and 116 turned off and starving the FETs 118 and 120 of current, which reinforces the off-state of the circuit 100.

The start-up circuit 110 is intended to ensure that operation of the regulator voltage output circuit 100 starts-up reliably when first connected to a source of power through the line 102. As the voltage Vbat builds up, the emitter of transistor 140 is held down to ground through the resistor R1 while its collector and base rise in voltage until the threshold base-emitter voltage is reached and the transistor 140 starts to conduct. The current from the transistor 140 flowing through the resistor R1 applies a voltage to the node 112, which starts to turn on the transistors 114 and 116, pulling down the drain voltage of the FET 118 and the gate voltages of the FETs 118 and 120, the current mirror effect establishing reciprocally the currents thus started.

The diodes 144 and 146 in series hold the voltage of the base of the transistor 140 down to twice the forward-biased P-N junction voltage drop, so that once the operation of the voltage regulator is fully established, the voltage of the node 112, and hence of the emitter of the transistor 140, rises above that of the transistor's base, turning it off so that substantially zero current flows through the transistor 140 of the start-up circuit 110. However, there remains substantial residual current flow through the diodes 144 and 146 even after the voltage regulator output circuit 100 is functioning normally or is in quiescent mode.

Figure 2:
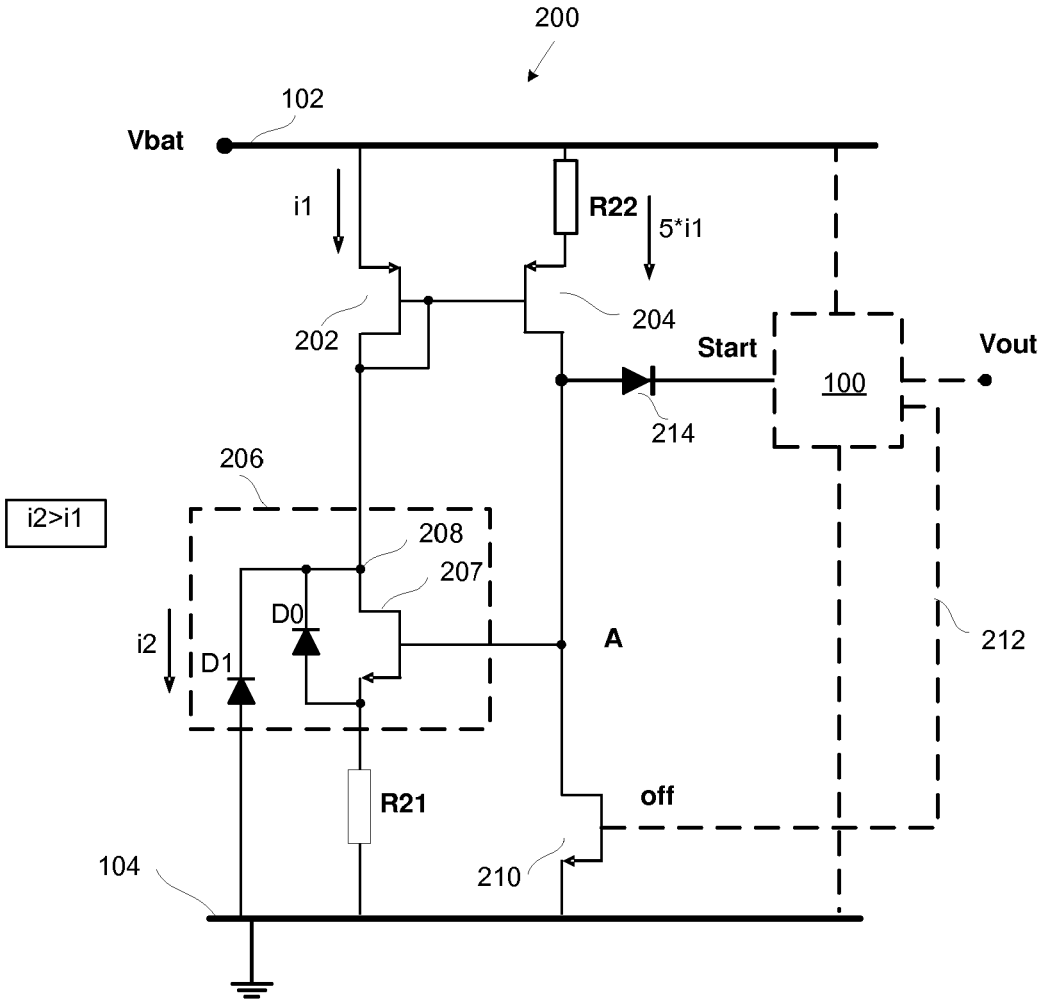
FIG. 2 is a schematic diagram of a start-up circuit element in electrical supply apparatus in accordance with an embodiment of the invention, given by way of example.

FIG. 2 shows a start-up circuit element 200 in accordance with one embodiment of the present invention, suitable for replacing the known start-up circuit 110 of FIG. 1, and which is incorporated in electrical supply apparatus to ensure that an output element 100, such as the voltage regulator of FIG. 1 for example, starts operation reliably when power is first applied from the source of power and in particular, in the case of a voltage regulator output circuit 100, ensures that the voltage regulator establishes the regulated output voltage Vout.

The start-up circuit 200 comprises Pmos FETs 202 and 204 whose sources are connected to the power supply rail 102, directly in the case of FET 202, and through a resistor R22 in the case of FET 204. The gates of the FETs 202 and 204 are connected together and to the drain of FET 202. The start-up circuit 200 also comprises a circuit element 206, in which the drain of FET 202 is connected to the drain of an Nmos FET 207 through a node 208, the source of FET 207 being connected to ground 104 through a resistor R21. The node 208 is connected through a reverse biased diode D0 to the source of FET 207 and hence through the resistor R21 to ground 104 and is also connected directly to ground in parallel with the FET 207, diode D0 and resistor R21, through a reverse biased diode D1.

Where the circuit element 206 is a vertical channel CMOS structure, the diodes D0 and D1 are conveniently integrated in the same die as the FET 207, the diode D0 being formed at least partially by the source-channel P-N junction and the diode D1 being formed at least partially by the drain-substrate P-N junction of the FET 207.

The drain of FET 204 is connected through a trigger node A to a drain of an Nmos control FET 210 whose gate is controlled in response to a feedback output 212 from the output circuit 100, which connects the gate of FET 210 to ground until the output voltage Vout of the output circuit 100 reaches a threshold value. The trigger node A is connected to the P side of a diode 214 whose N side is connected to a start terminal of the output circuit 100.

In operation, initially, before voltage is applied to the power supply rail 102, all the FETs and diodes of the start-up circuit 200, as well as the output circuit 100, are turned off. During the turn-on phase, when Vbat is first applied, even if it is increasing relatively slowly, the start-up circuit 200 is sure to start. The gate of the control FET 210 is maintained at ground by the feedback 212 so that the FET 210 is kept turned off. The diode D1 is chosen to have a much bigger junction area than the control FET 210 and also to have a bigger junction area than the FETs 202 and 204. Consequently, as the voltage Vbat rises, leakage currents from rail 102 are established through FETs 202 and 204 and through diode D1 to ground, the voltage of node 208 being held down close to ground initially. When the voltage Vbat increases, the gate-source voltage Vgs of FET 202 increases, following the equation Vbat−Vgs, until the small leakage current in FET 202 enables Vgs almost to reach the threshold voltage Vth of the FET 202, increasing the current in the FET 202 so that the voltage of the node 208 rises to Vbat−Vth. The common gate voltage of FETs 202 and 204 tends to turn on the FET 204, so that the drain current in FET 202 tends to be mirrored in FET 204. The drain current in FET 204 flows to a small extent as leakage through FET 210 to ground but especially applies voltage through diode 214 to the output circuit 100. As the voltage at the trigger node A rises to a value intermediate between Vbat and ground, it tends to enhance the turn on of the FETs 207 and 202 and hence the FET 204 by current mirror effect.

The area of FET 204 is chosen to be five times that of FET 202 so that, once the FETs 202, 204 and 207 conduct leakage current, the start current that is supplied by FET 204 through the diode 214 to the output circuit 100 can be up to five times the current i1 in FET 202. The maximum currents in FETs 204 and 207 are limited respectively by resistor 22 and resistor 21.

Once the output circuit 100 has safely started, the feedback output 212 of the output circuit applies a voltage to the gate of the FET 210 which starts to conduct, pulling the voltage at the trigger node A down towards ground. The gate-source voltage of the FET 207 becomes 0 or negative, due to the leakage current flowing through diode D0 and resistor R21, and the voltage at node 208 rises towards Vbat until FETs 202 and 204 start to turn off and then turn off completely, the non-return diode 214 preventing the FET 210 continuing to conduct, so that the start-up circuit 200 adopts its quiescent, standby state.

In a practical example, the junction area of the diode D1 is 1566 $\mu m^2$, that of the diode D0 is 200 $\mu m^2$, and the drain junction area of the control FET 210 has a reduced value of 484 $\mu m^2$ to reduce junction leakage to ground in the quiescent state, which is the state of the output circuit 100 and especially of the start-up circuit 200 during far the highest proportion of their operating life in typical automotive applications, for example. As the junction area ratio between D0 and FET 210 is 1566/484=3.23, the leakage current coming from Vbat to the point A during the start-up phase will be higher than the current from point A to ground (about 15 time more due to layout). In the example where the output circuit 100 is a 5V voltage regulator, the feedback output 212 of the voltage regulator will apply a voltage to turn off the start-up circuit 200 as soon as the output voltage reaches a 2.5V threshold, although other threshold voltages such as 1.5V could be adopted. During the start-up phase, the start current can reach 25 to 50 μAmps in this example, which only occurs occasionally during the lifetime of the start-up circuit. The time taken to generate the start current from the beginning of the start-up phase can be as short as about 2 msec. at room temperature and between 3 msec. and 130 μsec. at extreme operating temperatures. During the quiescent, standby phase, which represents the vast majority of its operational conditions, the total leakage current of the start-up circuit 200 is limited to about five times the leakage current of the circuit element 206 comprising diodes D0 and D1 and the FET 207, that is to say about 100 picoAmps.

It will be seen that, in this embodiment of the invention, the start-up circuit element 200, 400 comprises first and second branches with current mirror coupling therebetween. The first branch comprises first and second transistors 202, 207 of opposite polarities for connection in series between the source of power 102 and ground 104, and at least one leakage path D1 to ground 104 in parallel with the second transistor 207 of the first branch for start-up current for the first transistor of the first branch in response to application of voltage from the source of power 102. The second branch comprises a first transistor 204 for connection between the source of power 102 and a node A connected to the output element. The current mirror coupling between the first and second branches responds to start-up of the first transistor 202 of the first branch to start up the first transistor 204 of the second branch and provide start-up current through the node A to the output element 100.

In this embodiment of the invention, the second branch comprises a control element 210 connected between the node A and ground 104 and responsive to an output voltage from the output element 100, on start up of the output element, to turn off the second transistor 207 of the first branch and turn off the first transistors 202, 204. In this embodiment of the invention, the start-up circuit element 200 includes threshold means 328, 330 for maintaining the control element 210 non-conductive until the output voltage exceeds a threshold on start up of the output element 100 and for causing the control element 210 to conduct when the output voltage exceeds a threshold and turn off the transistors of the first and second branches, turning off the control element also. In this embodiment of the invention, the leakage current conduction area to ground of the control element 210 is smaller than the leakage current conduction areas of the first transistors 202, 204.

In this embodiment of the invention, the leakage path to ground comprises a P-N junction D1 that is reverse biased in operation. In this embodiment of the invention, the leakage path to ground also comprises a further P-N junction D0 that is reverse biased in operation, connected in parallel with the second transistor 207, and an impedance R21 in series between ground and the parallel combination of the second transistor 207 and the further P-N junction D0. In this embodiment of the invention, the leakage current conduction area of the P-N junction D1 in the leakage path to ground is greater than the leakage current conduction areas of the first transistors 202, 204.

Figure 3:
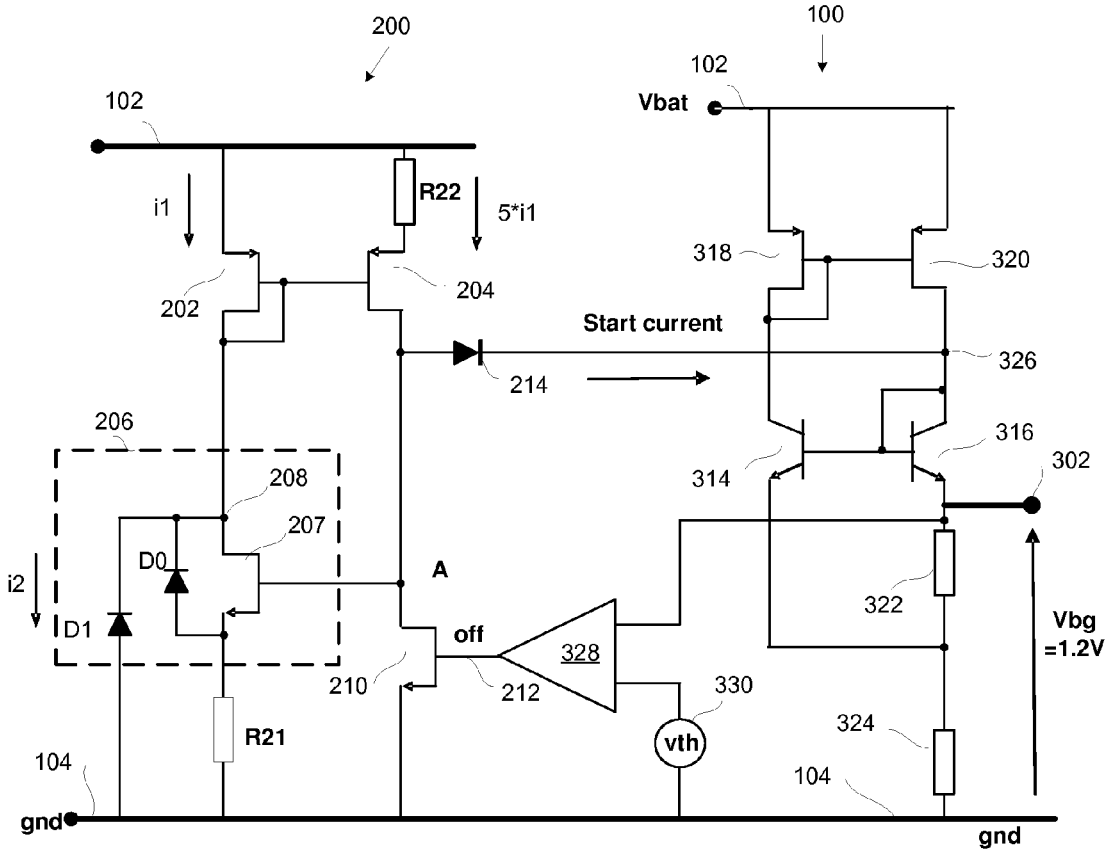
FIG. 3 is a schematic diagram of a regulator including a start-up circuit element and a band gap reference voltage circuit in electrical supply apparatus in accordance with another embodiment of the invention, given by way of example.

FIG. 3 shows another embodiment of the present invention, in which the start-up circuit 200 of FIG. 2 is used to ensure start up of a band-gap voltage reference circuit as output circuit 100. The band-gap circuit 100 provides a voltage Vbg at an output terminal 302 of 1.2 volts in the case of Silicon. The band-gap circuit comprises a pair of npn transistors 314 and 316, whose collectors are connected through P-type metal-oxide-Silicon ('Pmos') FETs 318 and 320 respectively to the power supply rail 102 in cross-coupled current mirror configuration, with the collectors of transistors 314 and 316 being connected to the drains of FETs 318 and 320 respectively. The FETs 318 and 320 are coupled together, with their gates connected together and to the drain of FET 318 and their sources connected to the power supply rail 102. The bases of transistors 314 and 316 are connected together and to the collector of transistor 316. The emitter of transistor 316 is connected through resistors 322 and 324 in series to ground 104 and the emitter of transistor 314 is connected to the common point between resistors 322 and 324 and therefore through the resistor 324 to ground. The base-emitter junction area of the transistor 316 is substantially larger than that of the transistor 314, by a facto of 8 in this example.

In normal operation, the current in the transistor 314 increases until its emitter voltage has risen sufficiently for its base-emitter voltage Vbe to exceed its threshold voltage. The current mirror formed by FETs 318 and 320 stabilises the common base voltage of the transistors 314 and 316 at a value such that the currents are equal in transistors 314 and 316. Because of the different base-emitter junction areas, the difference in current densities in the base-emitter junctions of the transistors 314 and 316 produces different base-emitter voltages in the transistors 314 and 316, so that the difference, ΔVbe, appearing across the resistor 322 is given by:

$$\Delta Vbe = \frac{kT}{q}\log n\frac{J314}{J316},$$

where k is the Boltzmann constant, T is the absolute temperature, q is the fundamental electron charge and J314 and J316 are the respective base-emitter junction areas of the transistors 314 and 316. Since the currents in transistors 314 and 316 are equal, the current in resistor 324 is twice that in resistor 322, so that the voltage across the resistor 324 is:

$$2\frac{kT}{q}\log n\frac{J314}{J316}.$$

The voltage Vbg is the sum of this voltage, approximately 0.6 volts at room temperature and which varies positively with temperature and the base-emitter voltage Vbe of the transistor 316, also approximately 0.6 volts at room temperature and which varies negatively with temperature, so that $$Vbg = Vbe + 2\frac{kT}{q}\log n\frac{J114}{J116},$$

where Vbg is the reference voltage at the output terminal 302. The resistances of 322 and 324 and the junction areas J314 and J316 are chosen so that the negative coefficient of temperature variation of the voltage Vbe (in this example approximately −2 mV/° K.) cancels the positive coefficient of temperature variation of the voltage difference ΔVbe (in this example approximately +2 mV/° K.) to a first order of approximation. The voltage Vbg is substantially independent of variations in power supply voltage Vbat.

As in the voltage regulator of FIG. 1, the parameters of the band-gap circuit of FIG. 2 are chosen so that it ought to be self-starting but there remains a risk that the circuit will not start by itself. The start-up circuit 200 is coupled to the band-gap circuit to avoid this risk, the N side of the diode 214 of the start-up circuit being connected to the connection 326 between the collector of the transistor 316 and the drain of the FET 320. When voltage is applied to the power supply rail 102 and the start-up circuit begins to supply current, the start current from the diode 214 pulls up the voltage at the connection 326 towards, but not as far as Vbat, and initiates current in the transistor 316, which is copied into the transistor 314 and pulls down current through the FET 318, which is copied into the FET 320, ensuring start up of the band-gap circuit output circuit 100.

The output 302 of the band-gap circuit 100 is connected to a positive input of a bi-stable comparator 328 with a source 330 of threshold voltage Vth connected to a negative input of the comparator and the comparator presenting a low impedance output connected to the gate 212 of the FET 210. Initially, before start-up, the low impedance output of the comparator 328 holds any voltage at the gate of the control FET 210 down close to ground, keeping the control FET 210 turned off. During the start-up phase, until the voltage Vbg at the output 302 exceeds the threshold voltage Vth, the gate 212 of the FET 210 is again held down to ground. After start-up of the output circuit 100, when the voltage Vbg at the output 302 exceeds the voltage Vth at the negative input of the comparator 328, the comparator applies a positive voltage to the gate 212 to start the FET 210 conducting, pulling the voltage at the trigger node A down to ground and turning off the start-up circuit 200; the FET 207 turns off first, the common base of FETs 202 and 204 rising towards Vbat, causing the voltage at the drain of FET 210 to fall towards ground and turn off the FET 210.

Figure 4:
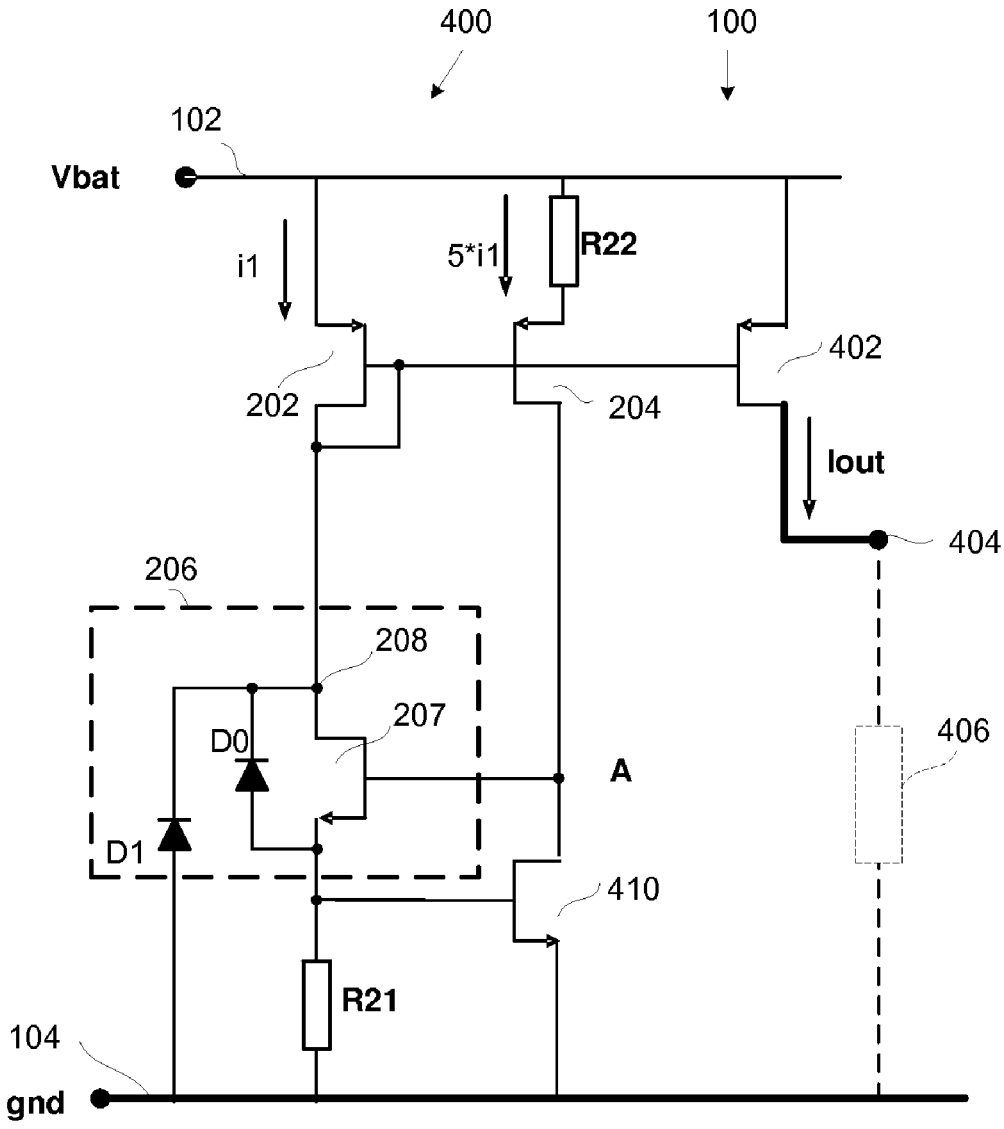
FIG. 4 is a schematic diagram of a current source including a start-up circuit element in electrical supply apparatus in accordance with another embodiment of the invention, given by way of example.

It is not necessary for the start-up circuit 200 to be totally separate from the output circuit or element 100 and some parts of the circuits can be common to both. FIG. 4 shows electrical supply apparatus of this kind, in which a start-up circuit 400 shares common parts with a constant current supply output element 100. In this case, the start-up circuit 400 is not turned off when the output element 100 has started.

As shown in FIG. 4, the start-up circuit 400 has similar elements to the elements of the start-up circuit 200 of FIG. 2, and which bear similar references. The constant current supply output element 100 comprises a Pmos FET 402 whose source is connected to the power supply rail 102, whose drain is connected to an output terminal 404 to supply current to a load 406 and whose gate is connected to the common connection of the gates of the FETs 202 and 204. The control FET 210 of FIG. 2 is replaced by an FET 410 whose source is connected to ground 104, whose drain is connected to the node A and whose gate is connected to the source of the FET 207, so that the pairs of FETs 207, 410 and 202, 204 are in cross-coupled mirror configuration.

Once normal operation is established, the output FET 402 copies the current in the FET 202, multiplying it by the ratio of the effective current conduction areas of the FETs 202 and 402, provided that the load 406 enables the voltage at the drain of the FET 402 to be similar to the voltage at the drain of the FET 204. At this stage, the current i1 in the FET 202 is given by Vgs(410)/R21, where Vgs(410) is the gate-source voltage of the FET 410.

Initially, before voltage is applied to the power supply rail 102, all the FETs and diodes of the start-up circuit 400, as well as the output circuit 100, are turned off. During the turn-on phase, when Vbat is first applied, even if it is increasing relatively slowly, the start-up circuit 400 is sure to start. The gate of the FET 410 is maintained at or close to ground through the resistor R21 so that the FET 410 is kept turned off. The diode D1 is chosen to have a much bigger junction area than the FET 410 and also to have a bigger junction area than the FETs 202 and 204. Consequently, as the voltage Vbat rises, the leakage currents from rail 102 are established through FETs 202 and 204 and through diode D1 to ground, the voltage of node 208 being held down close to ground initially. When the voltage Vbat increases, the gate-source voltage Vgs of FET 202 increases, following the equation Vbat−Vgs, until the small leakage current in FET 202 enables Vgs almost to reach the threshold voltage Vth of the FET 202, increasing the current in the FET 202 so that the voltage of the node 208 rises to Vbat−Vth. The common gate voltage of FETs 202 and 204 tends to turn on the FET 204, so that the drain current in FET 202 tends to be mirrored in FET 204 but limited by the resistor R22. The drain current in FET 204 flows to a small extent as leakage through FET 410 to ground. As the voltage at the node A rises to a value intermediate between Vbat and ground, it tends to enhance the turn on of the FETs 207 and 202 and the FET 204 by current mirror effect and hence the FET 402.

The invention claimed is:

1. Electrical supply apparatus comprising:

an output element; and a start-up circuit element coupled to the output element to ensure that the electrical supply apparatus reliably starts operation when first connected to a voltage of power supply rail, said start-up circuit element comprising first and second branches with current mirror coupling therebetween, said first branch comprising first and second transistors of opposite polarities coupled in series between the power supply rail and ground, and at least one leakage path coupled to the ground in parallel with said second transistor of said first branch to generate a start-up current through said first transistor of said first branch in response to an application of the voltage on the power supply rail, said second branch comprising a first transistor coupled between the power supply rail and a node connected to said output element, said current mirror coupling beteen said first and second branches to start up said first transistor of said second branch and to provide the start-up current through said node to the output element in response to the start-up current through said first transistor of said first branch, wherein said leakage path to ground comprises a P-N unction that is reverse biased in operation, and wherein a leakage current conduction area of said P-N junction in said leakage path to ground is greater than leakage current conduction areas of said first transistors.

2. Electrical supply apparatus as claimed in claim 1, wherein said second branch comprises a control element connected between said node and the ground, and the control element responsive to an output voltage from said output element, on start up of said output element, to turn off said second transistor of said first branch and to turn off said first transistors.

3. Electrical supply apparatus as claimed in claim 2, wherein said start-up circuit element includes a comparator and a threshold voltage source to maintain said control element in a non-conductive state until said output voltage exceeds a threshold voltage from the threshold voltage source on start up of said output element and to cause said control element to conduct when said output voltage exceeds the threshold voltage and to turn off said transistors of said first and second branches and the control element.

4. Electrical supply apparatus as claimed in claim 3, wherein said start-up circuit element includes a unidirectional coupling element to pass said start-up current between said node and said output element and to prevent flow of current in an opposite sense.

5. Electrical supply apparatus as claimed in claim 2, wherein a leakage current conduction area to ground of said control element is smaller than leakage current conduction areas of said first transistors.

6. Electrical supply apparatus as claimed in claim 1, wherein said leakage path to ground also comprises a further P-N junction that is reverse biased in operation, connected in parallel with said second transistor, and an impedance connected in series between the ground and the parallel combination of said second transistor and said further P-N junction.

7. Electrical supply apparatus as claimed in claim 1, wherein said output element comprises a current mirror.

8. Electrical supply apparatus as claimed in claim 1, wherein said output element comprises a voltage regulator or a voltage reference circuit.

9. Electrical supply apparatus as claimed in claim 1, wherein said output element comprises a band gap circuit.

10. Electrical supply apparatus as claimed in claim 1, wherein said output element comprises a current source.

11. Electrical supply apparatus as claimed in claim 10, wherein said output element comprises an output transistor, and said first transistors and said output transistor comprise respective control gates coupled together so that said output transistor copies with a multiplication ratio a current flowing in said first transistors.

12. A start-up circuit comprising:

a first transistor having a first current electrode coupled to a power supply rail, a second current electrode, and a control electrode coupled to the second current electrode;

a second transistor having polarity opposite of a polarity of the first transistor, the second transistor connected in series with the first transistor between the power supply rail and a ground;

a leakage current path connected to the ground in parallel with the second transistor, the leakage current path to provide a start-up current to the first transistor in response to a voltage being provided on the power supply rail; and a third transistor having a first current electrode coupled to the power supply rail, and a control electrode coupled to the control electrode of the first transistor, and a second current electrode coupled to a node, the third transistor to provide the start-up current to an output element in response to the start-up current in the first transistor, wherein the leakage current path is formed via a reversed biased diode connected in parallel with the third transistor, and an impedance connected in series between the ground and a combination of the reversed biased diode and the third transistor.

13. The start-up circuit of claim 12 further comprising:

a fourth transistor having a first current electrode coupled to the node, a second current electrode coupled to the ground, and a control electrode coupled to a feedback output, the fourth transistor to active in response to an output voltage received at the control electrode from the output element via the feedback output, and the fourth transistor to deactivate the first transistor and the third transistor in response to the fourth transistor being activated.

14. A method for controlling a start-up circuit, the method comprising:

providing a voltage on a power supply rail of the start-up circuit;

generating a leakage current from the power supply rail through a first transistor and a leakage path to ground in response to the voltage being provided on the power supply rail;

generating a start-up current in a second transistor in response to the leakage current through the first transistor, the second transistor being connected between the power supply rail and a node; and providing the start-up current to an output element via the node, wherein the leakage path is formed via a reversed biased diode connected in parallel with a third transistor, and an impedance connected in series between the ground and a combination of the reversed biased diode and a third transistor.

15. The method of claim 14 wherein the start-up current is a multiple times larger than the leakage current based on a difference between a size of the first transistor and a size of the second transistor.

16. The method of claim 14 further comprising:

receiving, at the third transistor coupled to the second transistor, an output voltage from the output element;

activating the third transistor in response to receiving the output voltage; and deactivating the first transistor and the second transistor while the third transistor is activated.

17. The method of claim 14 wherein the first transistor and the second transistor form a current mirror.

* * * * *